US008567386B2

(12) United States Patent
Cox

(10) Patent No.: US 8,567,386 B2
(45) Date of Patent: Oct. 29, 2013

(54) SELF-POWERED AIR CIRCULATING DEVICE FOR USE IN CONNECTION WITH A RADIANT HEAT OVEN

(76) Inventor: Ty Cox, Austin, TX (US)

( * ) Notice: Subject to any disclaimer, the term of this patent is extended or adjusted under 35 U.S.C. 154(b) by 292 days.

(21) Appl. No.: 13/206,606

(22) Filed: Aug. 10, 2011

(65) Prior Publication Data

US 2013/0037015 A1 Feb. 14, 2013

(51) Int. Cl.
*F24C 15/32* (2006.01)

(52) U.S. Cl.
USPC ..... 126/21 R; 126/21 A

(58) Field of Classification Search
USPC ..... 126/21 A, 21 R, 110 R, 116 R, 39 R, 126/273 R, 273.5; 99/474; 136/203, 200, 136/205
See application file for complete search history.

(56) References Cited

U.S. PATENT DOCUMENTS 5,544,488 A 8/1996 Reid
5,967,135 A 10/1999 Shariat
7,812,245 B2 10/2010 Reid
2008/0087315 A1 4/2008 Deming et al.
2008/0184986 A1 8/2008 Kohlstrung
2009/0229476 A1* 9/2009 Bedard ..... 99/447

FOREIGN PATENT DOCUMENTS

JP 2003-121002 4/2003

* cited by examiner

*Primary Examiner* — Alfred Basichas
(74) *Attorney, Agent, or Firm* — Maxey Law Offices, PLLC; Stephen Lewellyn

(57) ABSTRACT

A thermoelectric powered air circulating device for use in connection with a conventional radiant heat oven operates to circulate heated air within the oven to promote convection cooking therewithin that otherwise would not be possible without the device. The device includes a container having a quantity of fluid therein, a thermoelectric device, a first heat exchange structure connected to the thermoelectric device and configured to conduct heat between the thermoelectric device and the quantity of fluid, a second heat exchange structure connected to the thermoelectric device and configured to conduct heat between the thermoelectric device and the heated air with the oven space, and an electric fan operably connected to the thermoelectric device to receive electrical power therefrom. A temperature differential in the thermoelectric device causing the thermoelectric device to generate electrical energy to power the electric fan, thereby resulting in the circulation of the heat air within the oven space.

9 Claims, 3 Drawing Sheets

SELF-POWERED AIR CIRCULATING DEVICE FOR USE IN CONNECTION WITH A RADIANT HEAT OVEN

FIELD OF THE INVENTION

The present invention relates generally to cooking devices, and more particularly, relating to a self-powered air circulating device that is removably inserted into a radiant heat oven to effectively convert the radiant heat oven into a steam convection oven.

BACKGROUND OF THE INVENTION

Radiant heat ovens are known and exist in the art and comprise of an oven space that is heated by heat generated by electrical resistant heating elements or gas burners. Radiant heat ovens are prone to developing areas of higher temperatures within the oven space, which results in non-uniform cooking.

Convection ovens and steam convection ovens are also known and exist in the art and comprise of an oven space that is also heated by electric resistant heating elements and/or gas burners. However, unlike radiant heat ovens, convection ovens include a fan or blower that is operated to recirculate the hot air in the oven space. As a result, the oven space is uniformly heated and areas of higher temperatures are prevented from developing. The uniform heat distribution within the oven space results in quicker cooking times over radiant heat ovens and uniform cooking. Despite the benefits provided by convention ovens, the cost to purchase and maintain a convention oven limits their use in the typical residential household.

Accordingly, there is a need for a device for use with a radiant heat oven that is capable of providing the benefits of a convection oven to the radiant heat oven without requiring modification of the radiant heat oven.

SUMMARY OF THE INVENTION

Embodiments of the present invention addresses these needs by providing an air circulating device that is removably inserted into the oven space of a radiant heat oven to circulate the hot air within the oven space to provide benefits of a convection oven.

Embodiments of the present invention also provide an air circulating device that is removably inserted into the oven space of a radiant heat oven to circulate the hot air within the oven space and which includes an electrically driven fan that is powered by a thermoelectric device that is operated by a temperature differential across the thermoelectric device between the hot air within the oven space and a cooler temperature fluid contained by the device.

Embodiments of the present invention also provide an air circulating device that is removably inserted into the oven space of a radiant heat oven to circulate the hot air within the oven space and which operates to generate and emit steam into the oven space.

Embodiments of the present invention also provide an air circulating device that is removably inserted into the oven space of a radiant heat oven to circulate the hot air within the oven space and which is supported within the oven space by an existing cooking rack.

Embodiments of the present invention also provide an air circulating device that is removably inserted into the oven space of a radiant heat oven to circulate the hot air within the oven space and which does not require modification to the radiant heat oven.

Embodiments of the present invention further provide an air circulating device that is removably inserted into the oven space of a radiant heat oven to circulate the hot air within the oven space and which easy to operate and of a simple construction.

To achieve these and other advantages, in general, in one aspect, a self-powered air circulating device for use in connection with a radiant heat oven to create an air flow within the oven space of the radiant heat oven to circulate heated air within the oven space is provided. The device includes a container having a quantity of fluid therein, a thermoelectric device, a first heat exchange structure connected to the thermoelectric device and configured to conduct heat between the thermoelectric device and the quantity of fluid, a second heat exchange structure connected to the thermoelectric device and configured to conduct heat between the thermoelectric device and the heated air with the oven space, and an electric fan operably connected to the thermoelectric device to receive electrical power therefrom. The conduction of heat between the heated air within the oven space and the thermoelectric device and the conduction of heat between the quantity of fluid and the thermoelectric device creates a temperature differential in the thermoelectric device causing the thermoelectric device to generate electrical energy to power the electric fan, thereby resulting in the circulation of the heat air within the oven space.

In general, in another aspect, a self-powered air circulating device for use in connection with a radiant heat oven to create an air flow within the oven space of the radiant heat oven to circulate heated air within the oven space is provided. The device includes a container having an open top and that is configured to receive and retain a quantity of fluid therein. The container further constructed and arranged to be supported upon an existing structure within the oven space of the radiant heat oven. A thermoelectric device includes first and second surfaces. A first heat exchange structure has a first end disposed within the container and in thermal contact with the quantity of fluid and a second end disposed exteriorly of the container and attached to the first surface of the thermocouple device. The first heat exchange structure conducts heat between the quantity of fluid and the first end of the thermoelectric device. A second heat exchange structure is connected to the second surface of the thermoelectric device and conducts heat between the heated air within the oven space and the second surface of the thermoelectric device. An electric fan is operably connected to the thermoelectric device and the conduction of heat between the heated air within the oven space and the second surface of the thermoelectric device and the conduction of heat between the quantity of fluid and the first surface of the thermoelectric device creates a temperature differential between the first surface and the second surfaces of the thermoelectric device causing the thermoelectric device to generate electrical energy to power the electric fan, thereby resulting in the heated air within the oven space to be circulated therewithin.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
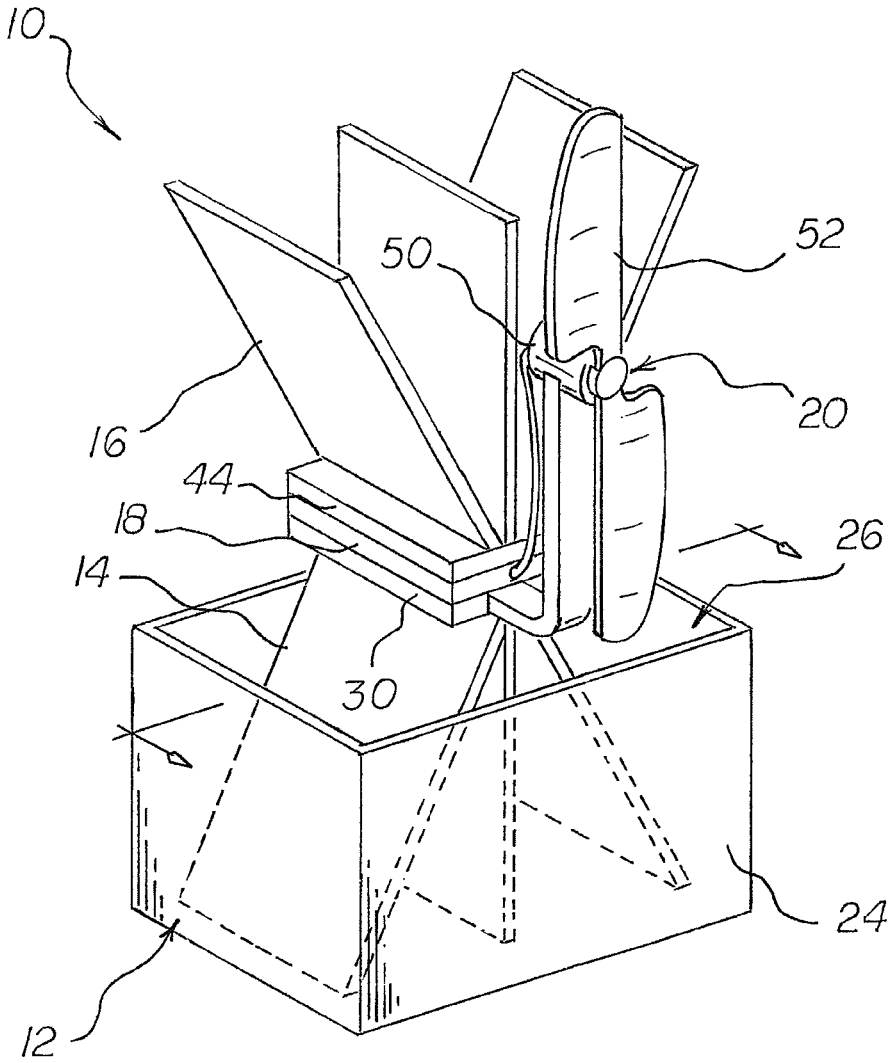
FIG. 1 is a perspective view of an embodiment of a self-powered air circulating device in accordance an embodiment the invention.
Figure 2:
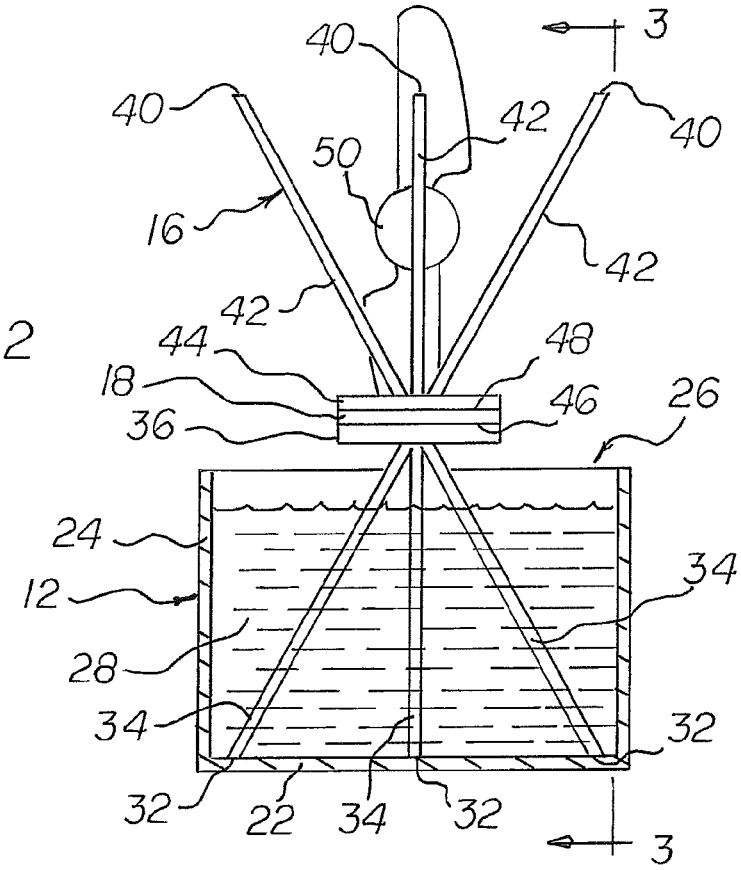
FIG. 2 is a cross-sectional view taken along line 2-2 in FIG. 1.
Figure 3:
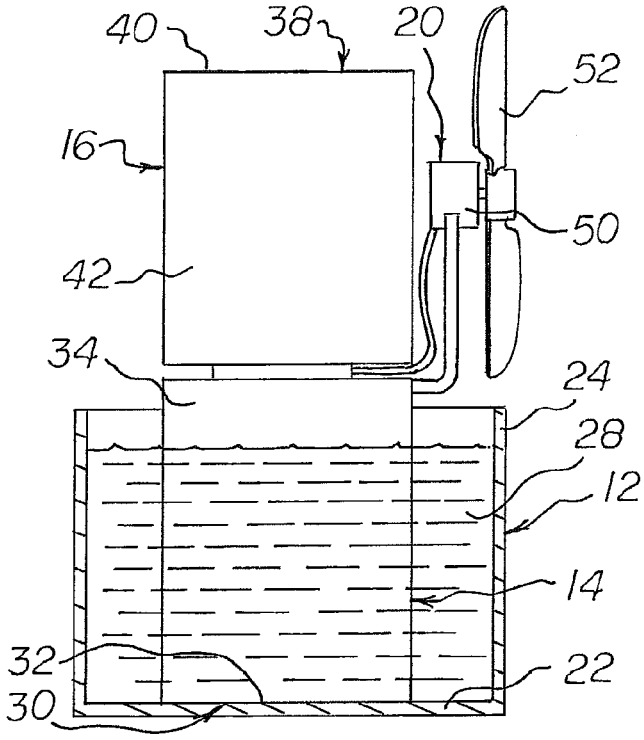
FIG. 3 is a cross-sectional view taken along line 3-3 in FIG. 2.

In FIGS. 1 through 3, there is representatively illustrated a self-powered air circulating device 10 in accordance with an embodiment of the invention. Device 10 is for use in connection with a radiant heat oven and operates to circulate heated air within the oven space of the radiant heat oven for convection cooking that otherwise would not be possible without device 10.

Device 10 includes a container 12, a first heat exchanger structure 14, a second heat exchanger structure 16, a thermoelectric device 18 and an electric fan 20. The container 12 is generally of a pan-type construction including a bottom wall 22, a sidewall 24 extending upwardly from the bottom wall and terminating at an open top 26. The container 10 is configured to receive and retain a quantity of fluid 28, such as plain water or water mixed with food flavoring. As will be discussed further, the fluid 28 serves two functions, including the function of a heat sink and to provide steam as the fluid is evaporated.

The first heat exchanger structure 14 includes a first end 30 including ends 32 of heat conducting fins 34 and an opposite second end 36. The first end 30 may include a base (not shown) that connects the ends 32 of the heat conducting fins. A portion of the heat exchange structure 14 including the first end 30 is disposed interiorly of the container 12 and in thermal contact with the fluid 28 container therein. The remaining portion of the heat exchange structure 14 extends vertically through opening 26 and terminates at the second end 36 at an exteriorly disposed location of the container 12. The first heat exchanger structure 14 may be configured to have various shapes and forms as desired and still remain within the scope of the invention.

The second heat exchanger structure 16 includes a first end 38 including ends 40 of heat conducting fins 42 and an opposed second end 44. Similarly to the first heat exchanger structure 14, the first end 38 may include a top (not shown) that connects the ends the ends 40 of the heat conducting fins 42. The entire second heat exchanger structure 16 is disposed exteriorly of the container 12 and vertically above the first heat exchanger structure 14. The second heat exchanger structure 16 may be configured to have various shapes and forms as desired and still remain within the scope of the invention.

Thermoelectric device 18 operates to generate an electric current (electric power) when a temperature gradient exists between opposite sides of the thermoelectric device according the well-known Seebeck affect, also referred to as the Peltier-Seebeck affect. Such thermoelectric devices are well known in the art, and because of this, a complete description of their construction and principal of operation is not warranted for the understanding of the embodiments of the invention, and thus will not be had herein. An example of such thermoelectric device is described in U.S. Pat. No. 5,544,488, the entirety of which is incorporated herein by reference. The thermoelectric device 18 is disposed between the second end 36 of the first heat exchange structure 14 and the second end 44 of the second heat exchange structure 16. The second end 36 is attached to a first side or surface 46 of the thermoelectric device 18 and the second end 44 is attached to a second side or surface 48 of the thermoelectric device.

The first heat exchange structure 14 conducts heat between the fluid 28 contained by the container 12 and the first surface 46 of the thermoelectric device 18. The second heat exchanger structure 16 conducts heat between the ambient air surrounding the second heat exchanger structure 16 and the second surface 48 of the thermoelectric device 18.

The electric fan 20 includes an electric motor 50 and a fan blade 52 secured to and driven by the electric motor. The electric fan 20 is illustrated as being connected to and supported by the first heat exchanger structure 14. In other embodiments, the electric fan 20 may be connected to and supported by another structure other than the first heat exchanger structure 14 and still remain within the scope of the invention. The electric motor 50 of the electric fan 20 is operatively connected to the thermoelectric device 18 to receive electrical power therefrom to drive the fan blade 52.

Figure 4:
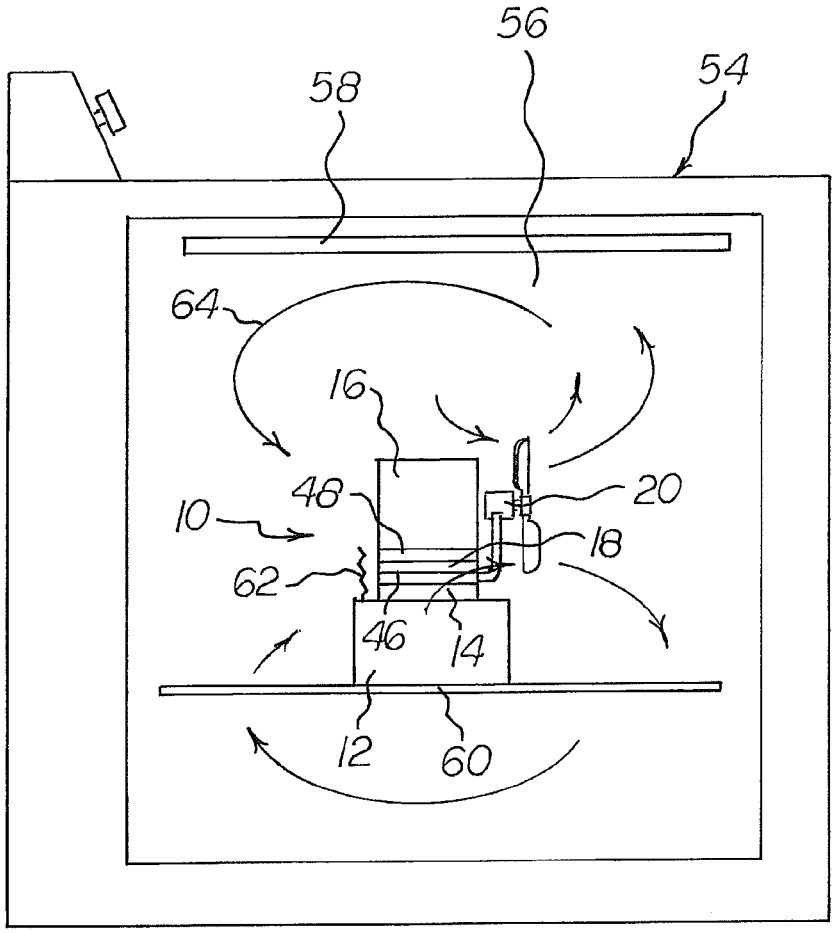
FIG. 4 is a diagrammatic environmental view of a self-powered air circulating device in accordance with an embodiment of the invention disposed within a conventional radiant heat oven and in use (proportions are exaggerated for clarity).

With further reference to FIG. 4, there is diagrammatically illustrated a conventional radiant heat oven 54 having an oven space 56 and a heating element 58 located atop the oven space. Heating element 58 is operated to heat the air within the oven space to cook food placed therein. Further illustrated in FIG. 4 is device 10, which is disposed within the oven space 56 and supported upon a cooking rack 60 of the oven 54. Fluid or water 28 (not shown) in container 12 is heated by the hot air within the oven space 56 and heating element 58 to a boil causing the water to evaporate into the oven space as steam 62. The hot air within the oven space 56 is heated to a greater temperature than the temperature of the boiling water. Heat is conducted away from the first surface 46 of the thermoelectric device 18 by the first heat exchanger structure 14 and into the water 28 as a result of the temperature difference between the water and the heat air. Heat from the heated air is also conducted towards the second surface 48 of the thermoelectric device 16 by the second heat exchanger structure 16. The temperature difference across the first and second surfaces 46 and 48 of the thermoelectric device 18 caused by heat being conducted from the thermoelectric device and into the water and heat being conduct from the heated heat to the thermoelectric device results in the generation of electrical power by the thermoelectric device. The electrical power generated by the thermoelectric device 18 powers the electric fan 20 causing the heated air 64 and steam 62 to be circulated within the oven space 56, and thus converting the conventional radiant heat oven 54 into a steam convection oven.

A number of embodiments of the present invention have been described. Nevertheless, it will be understood that various modifications may be made without departing from the spirit and scope of the invention. Accordingly, other embodiments are within the scope of the following claims.

What is claimed is:

1. A self-powered air circulating device for use in connection with a radiant heat oven to create an air flow within the oven space of the radiant heat oven to circulate heated air within the oven space, the device comprising:

a container having a quantity of fluid therein;

a thermoelectric device;

a first heat exchange structure connected to said thermoelectric device and configured to conduct heat between said thermoelectric device and said quantity of fluid;

a second heat exchange structure connected to said thermoelectric device and configured to conduct heat between said thermoelectric device and the heated air within the oven space;

an electric fan operably connected to said thermoelectric device to receive electrical power therefrom; and wherein said conduction of heat between said heated air within the oven space and said thermoelectric device and said conduction of heat between said quantity of fluid and said thermoelectric device creates a temperature differential in said thermoelectric device causing said thermoelectric device to generate electrical energy to power said electric fan, thereby resulting in the circulation of the heated air within the oven space.

2. The device of claim 1, wherein said electric fan is connected to and supported by said first heat exchange device.

3. The device of claim 1, wherein said first heat exchange device includes one or more heat conducting fins.

4. The device of claim 1, wherein said second heat exchange device includes one or more heat conducting fins.

5. The device of claim 1, wherein said container has an opening permitting steam from said fluid to enter into the oven space.

6. A self-powered air circulating device for use in connection with a radiant heat oven to create an air flow within the oven space of the radiant heat oven to circulate heated air within the oven space, the device comprising:

a container having an open top and configured to receive and retain a quantity of fluid therein;

a thermoelectric device having first and second surfaces;

a first heat exchange structure having a first end disposed within said container and a second end disposed exteriorly of said container and attached to said first surface of said thermoelectric device, said first heat exchange structure conducting heat between said quantity of fluid and said first end of said thermoelectric device;

a second heat exchange structure connected to said second surface of said thermoelectric device and disposed exteriorly of said container, said second heat exchange structure conducting heat between the heated air within the oven space and said second surface of said thermoelectric device; and an electric fan operably connected to said thermoelectric device.

7. A self-powered air circulating device for use in connection with a radiant heat oven to create an air flow within the oven space of the radiant heat oven to circulate heated air within the oven space, the device comprising:

a container having an open top and configured to receive and retain a quantity of fluid therein, said container further constructed and arranged to be supported upon an existing structure within the oven space of the radiant heat oven;

a thermoelectric device having first and second surfaces;

a first heat exchange structure having a first end disposed within said container and in thermal contact with said quantity of fluid and a second end disposed exteriorly of said container and attached to said first surface of said thermoelectric device, said first heat exchange structure conducting heat between said quantity of fluid and said first end of said thermoelectric device;

a second heat exchange structure connected to said second surface of said thermoelectric device, said second heat exchange structure conducting heat between the heated air within the oven space and said second surface of said thermoelectric device;

an electric fan operably connected to said thermoelectric device; and wherein said conduction of heat between said heated air within the oven space and said second surface of said thermoelectric device and said conduction of heat between said quantity of fluid and said first surface of said thermoelectric device creates a temperature differential between said first surface and said second surfaces of said thermoelectric device causing said thermoelectric device to generate electrical energy to power said electric fan, thereby resulting in the heated air within the oven space to be circulated therewithin.

8. The device of claim 7, wherein said first end of said first heat exchange device is connected to a bottom wall of said container.

9. The device of claim 8, wherein said first end of said first heat exchange device is free from connection to a sidewall of said container.

* * * * *